US005398658A

United States Patent [19]

Mesimäki

[11] Patent Number: 5,398,658

[45] Date of Patent: Mar. 21, 1995

[54] MOUNTING AND CONNECTION ARRANGEMENT FOR A FUEL INJECTION PUMP

[75] Inventor: Olavi Mesimäki, Vaasa, Finland

[73] Assignee: Wartsila Diesel International Ltd. Oy, Helsinki, Finland

[21] Appl. No.: 131,766

[22] Filed: Oct. 4, 1993

Related U.S. Application Data

[63] Continuation of Ser. No. 867,179, Apr. 9, 1992, abandoned.

[30] Foreign Application Priority Data

Apr. 17, 1991 [FI] Finland ..... 911848

[51] Int. Cl.[6] ..... F02M 37/04

[52] U.S. Cl. ..... 123/509; 123/456; 123/495; 417/499

[58] Field of Search ..... 123/509, 495, 449, 508, 123/456; 417/499

[56] References Cited

U.S. PATENT DOCUMENTS

| | | | |
|---|---|---|---|
| 2,670,684 | 3/1954 | Fagerholt | 417/499 |
| 3,139,830 | 7/1964 | Umezawa . | |
| 4,286,931 | 9/1981 | Hafele et al. . | |
| 4,530,335 | 7/1985 | Torizuka | 123/495 |
| 4,543,045 | 9/1985 | Ritter | 417/499 |
| 4,640,255 | 2/1987 | Hafele | 123/495 |
| 4,770,149 | 9/1988 | Kramer | 123/509 |
| 4,850,823 | 7/1989 | Guntert | 417/499 |
| 4,989,571 | 2/1991 | Güentert | 123/509 |

FOREIGN PATENT DOCUMENTS

| | | | |
|---|---|---|---|
| 826216 | 12/1951 | Germany . | |
| 2521409 | 11/1976 | Germany . | |
| 3105412 | 9/1982 | Germany . | |
| 0059054 | 4/1982 | Japan | 123/495 |
| 0192961 | 11/1983 | Japan | 123/495 |
| 3286179 | 12/1991 | Japan | 123/495 |
| 225637 | 2/1943 | Switzerland | 123/495 |
| 1346195 | 2/1974 | United Kingdom . | |
| 2038975 | 1/1979 | United Kingdom . | |
| 2143908 | 2/1985 | United Kingdom | 123/495 |
| 2170558 | 8/1986 | United Kingdom . | |

*Primary Examiner*—Carl S. Miller
*Attorney, Agent, or Firm*—Smith-Hill and Bedell

[57] ABSTRACT

Mounting and connection arrangement for a fuel injection pump in large reciprocating internal combustion engines, especially in large diesel engines with several cylinders, which include a separate injection pump (1) for separate cylinders and in which the injection pump (1) is supported to a console support (3) or to a corresponding element forming an integral part of or fixed to the engine block. The injection pump (1) is arranged to be fixed on the console support (3) by making use of a support unit (2), which is also provided with guiding members (4,7,8,9) for one or several control or pressure medium systems in association with the operation of the engine. These guiding members can include channels (7,8) for feeding fuel into the pump, guiding members (4) for valve lifting means (5) and/or lubrication channels (9).

24 Claims, 5 Drawing Sheets

MOUNTING AND CONNECTION ARRANGEMENT FOR A FUEL INJECTION PUMP

Figure 1:
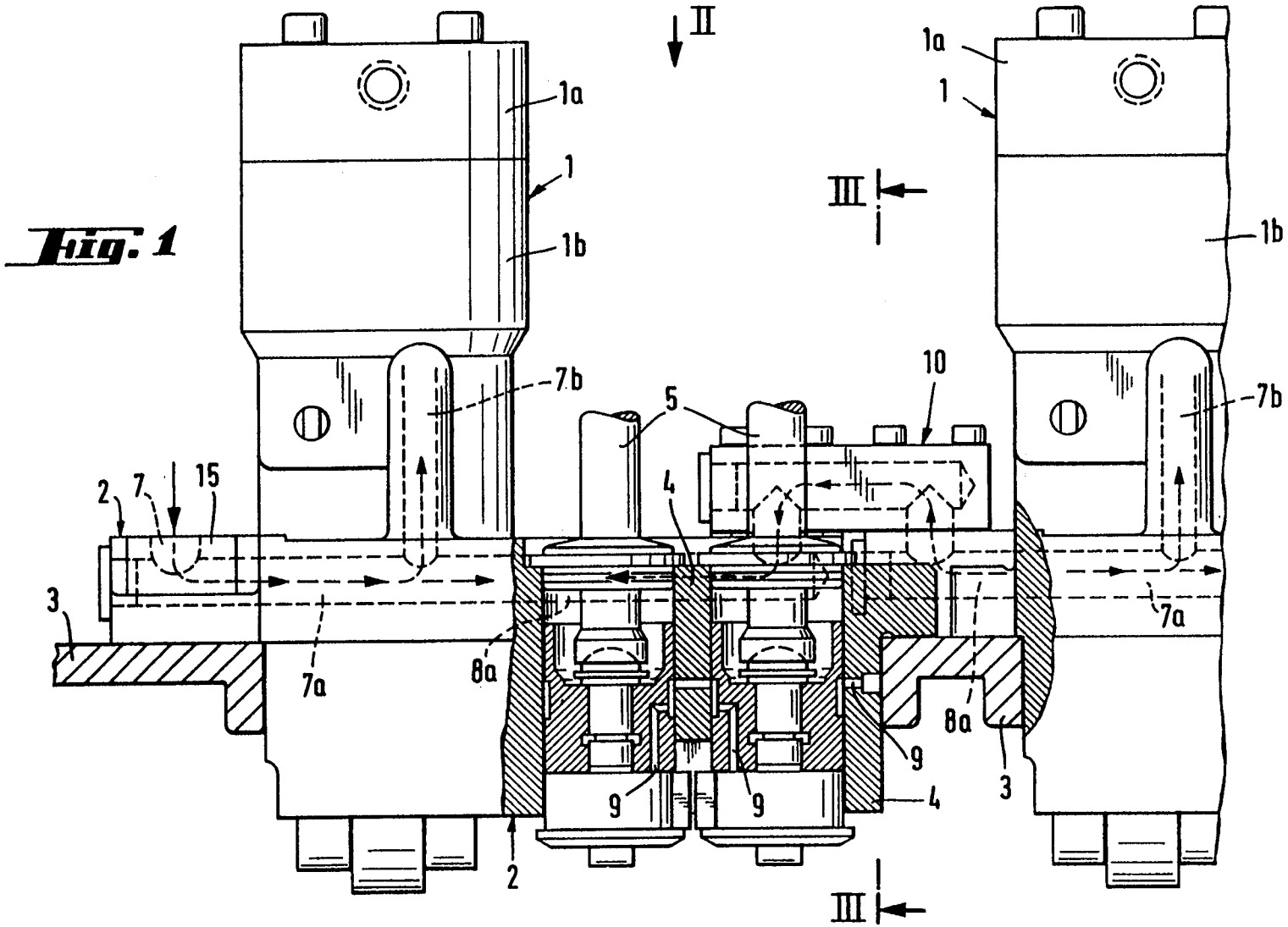

This application is filed as a continuation of patent application Ser. No. 07/867,179, filed Apr. 9, 1992, and now abandoned.

The invention relates to a mounting and connection arrangement for a fuel injection pump in large reciprocating internal combustion engines, especially in large diesel engines with several cylinders, which include a separate injection pump for separate cylinders and in which the injection pump is supported to a console support or to a corresponding element forming an integral part of or fixed to the engine block.

In large engines injection pumps are generally located on a special pump console support extending along the engine block. A console support can be an integral part of the engine block but also a separate element fixed thereto. It can also with advantage be covered so as to form a box-like member for protecting the pumps, pipes and possible other devices arranged on it. The term "large diesel engine" as used herein refers to a diesel engine that is applicable for use as a main propulsion engine or auxiliary engine for a ship or in a heating power plant etc..

In known solutions fuel is led to the injection pipes and the excessive fuel, respectively, is returned for recirculation through separate pipes included in the fuel feeding system of the engine. Pressure peaks from the fuel pump operating under high pressure cause strain, cracks and wear in the fuel pipes and especially in the sealing positions. This has resulted in using thick walled pipes which are allowed to move supported by the sealings of a distribution housing included in the fuel feeding system of the engine. Alternatively the pumps are connected to the distribution pipes with thinner pipes by making use of flange joints. The sealings of the distribution housing wear out rather quickly causing leakage problems. On the other hand the thinner pipes connected to the distribution pipes can break at the welded spots due to pressure shocks and stresses, which are at their very biggest at the immediate vicinity of the pump.

On the other hand in large engines the pump console support is made use of for supporting and leading also guiding means and devices of other systems relating to the operation of the engine which need fixing positions and fixing means of their own. This requires space and the various separate components cause extra work and incur additional costs for the production and installation thereof.

An aim of the invention is to create an improved mounting and connection arrangement for a fuel injection pump for big internal combustion engines, by means of which the drawbacks appearing in the known technique as referred above can essentially be eliminated.

The aims can be met with the arrangement in accordance with the invention according to which the injection pump is fixed on the console support by making use of a support unit, which is also provided with guiding members for one or several control or pressure medium systems in association with the operation of the engine. This kind of support unit, either separate or partly integrated with the pump, makes it possible to connect together different kinds of devices and means on the pump console support of the engine, which is of advantage from the viewpoint of production and space requirements.

The support unit itself can with advantage be provided with channels and connecting means, by means of which the injection pump is connected to the pipes of the fuel feeding system for the engine, because a stationary and uniform support unit can withstand pressure shocks and vibrations caused by the injection pump much better than various separate pipes, which, hence, can be avoided in the immediate vicinity of the injection pumps themselves.

In accordance with one embodiment of the invention the support unit includes two separate channels preferably positioned on the opposite sides of the injection pump relative to the longitudinal axis thereof, each of said channels being separately connected to the cylinder of the injection pump for feeding fuel into the pump and for leading excessive fuel away from the pump back into the pipes of the fuel feeding system.

Two or several support units for the injection pumps for adjoining cylinders can further be arranged to be connected together so that each of the said fuel channel arrangements of the support units forms a uniform fuel flow unit to be connected to the pipes of the fuel feeding system.

A specially advantageous solution from the viewpoint of the aims of the invention is accomplished, when the support unit together with the fuel channel arrangements is arranged to form an integral part of the body member of the injection pump.

In view of production technique and space requirements the solution can further be improved by providing the support unit additionally with guiding members for lifting means for one or several valves in association with the cylinders of the engine so that said valve lifting means are arranged to be led through the pump console support by making use of said guiding members. In addition the support unit can include channels for feeding lubricant so as to provide lubrication for the piston member of the injection pump and/or for the valve lifting means.

The support unit constitutes with advantage a substantially uniform piece of casting, into which at least a majority of said channels and connecting means can be arranged to be ready. Hereby it is possible to fit together several different devices and parts of different systems and at the same time to make the production and installation on the pump console support more simple.

Figure 2:
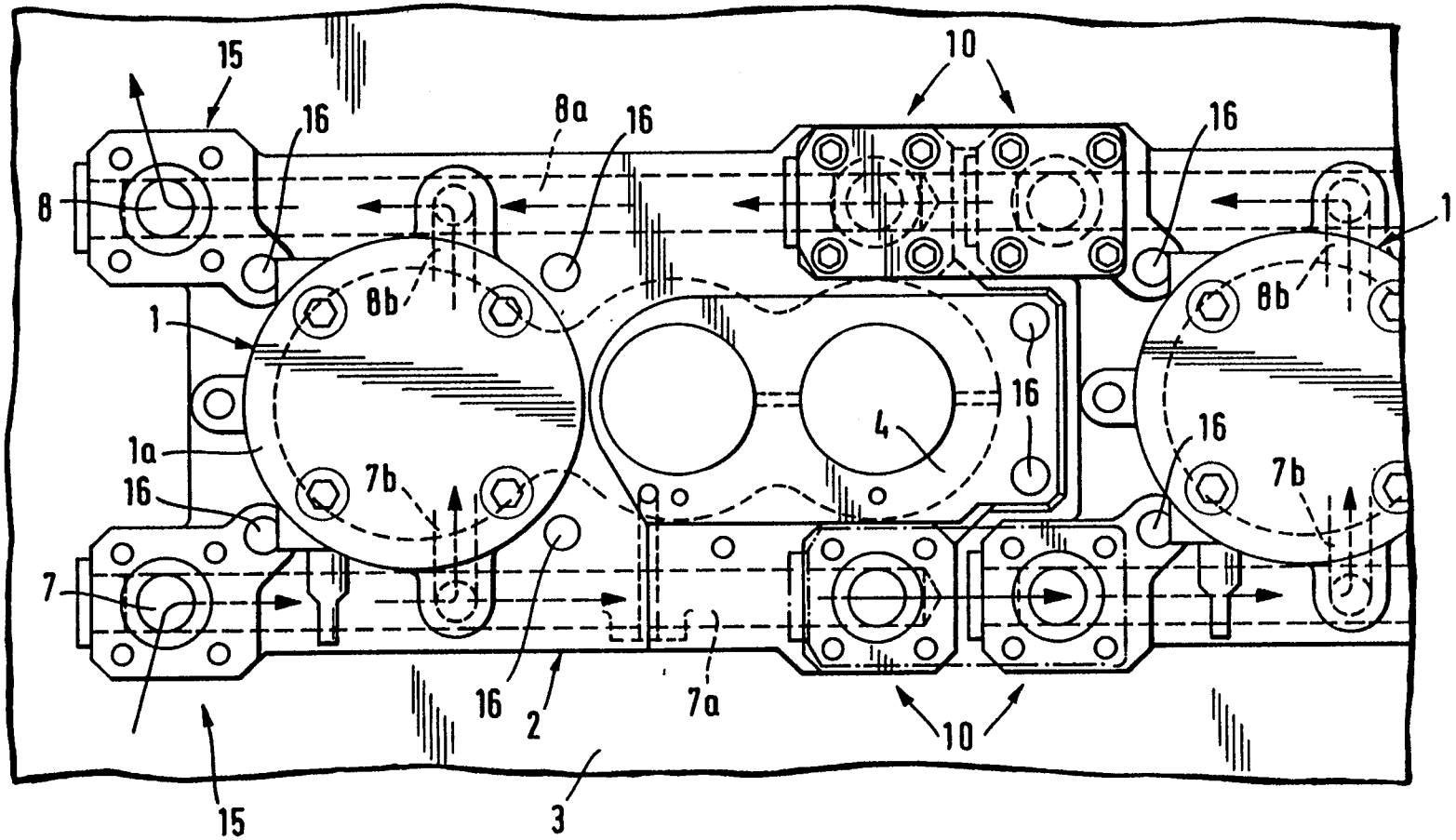
Figure 4:
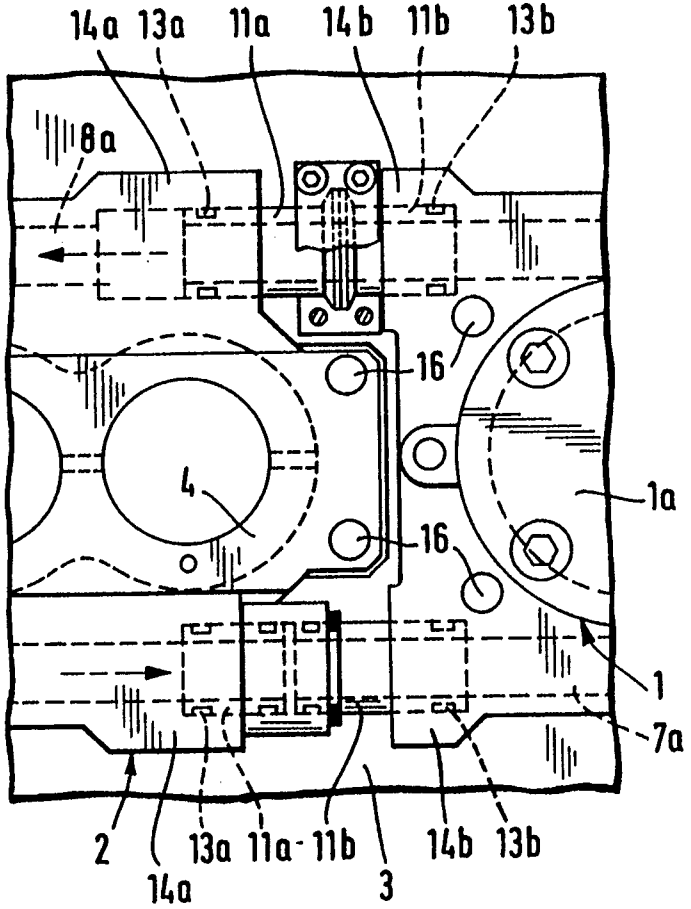
Figure 3:
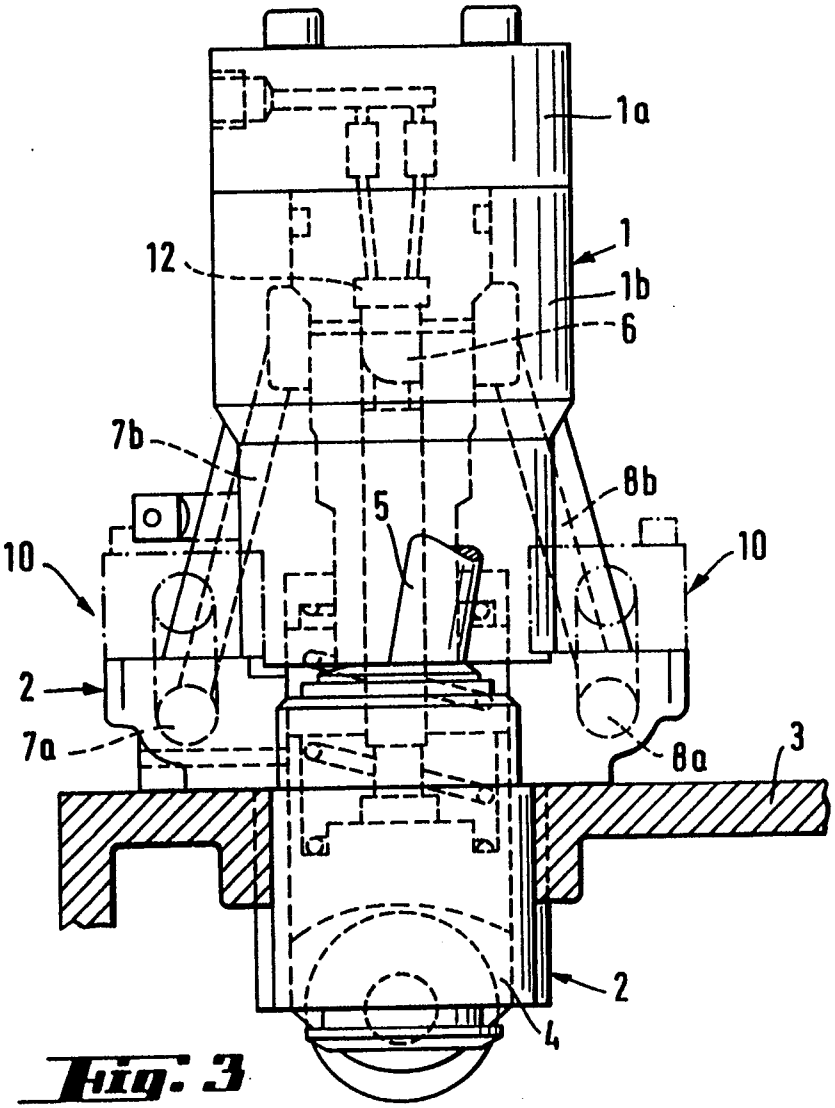
Figure 5:
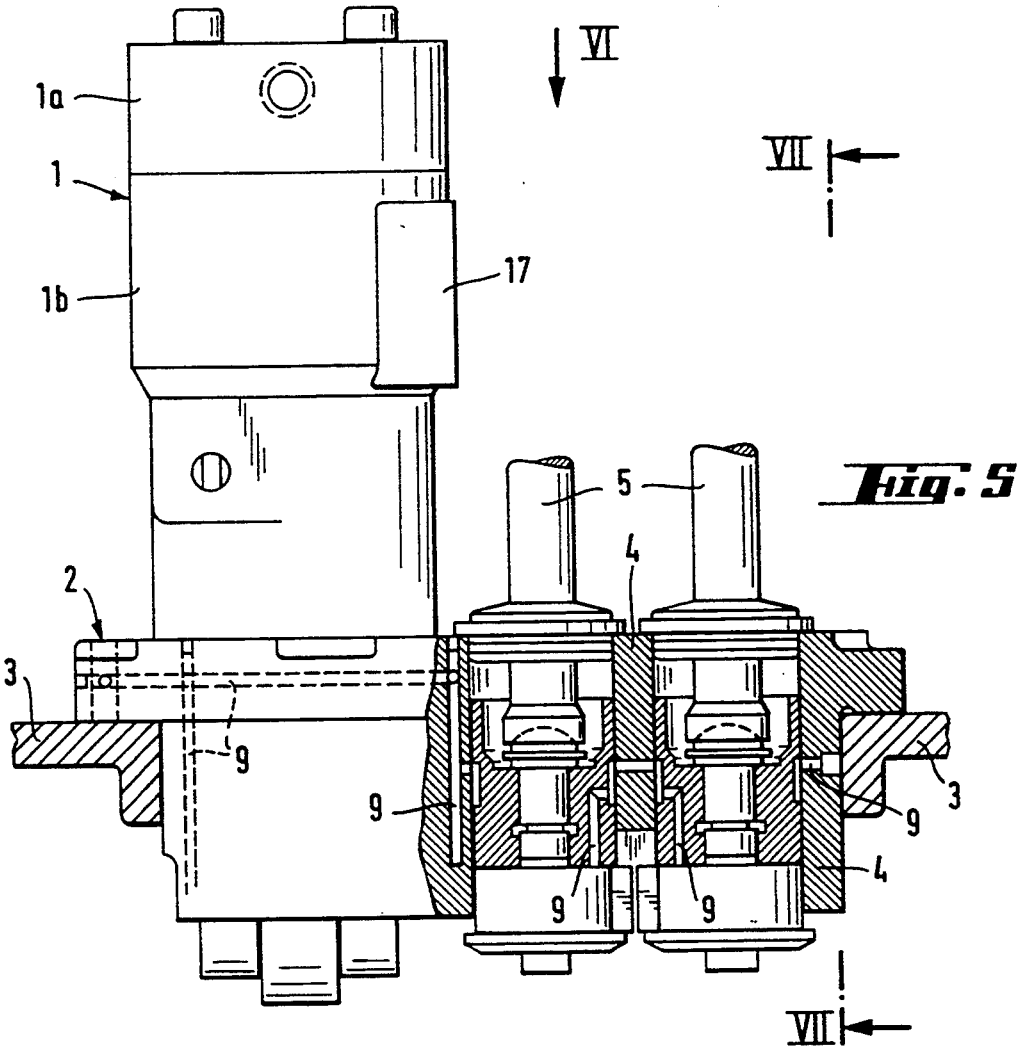
Figure 6:
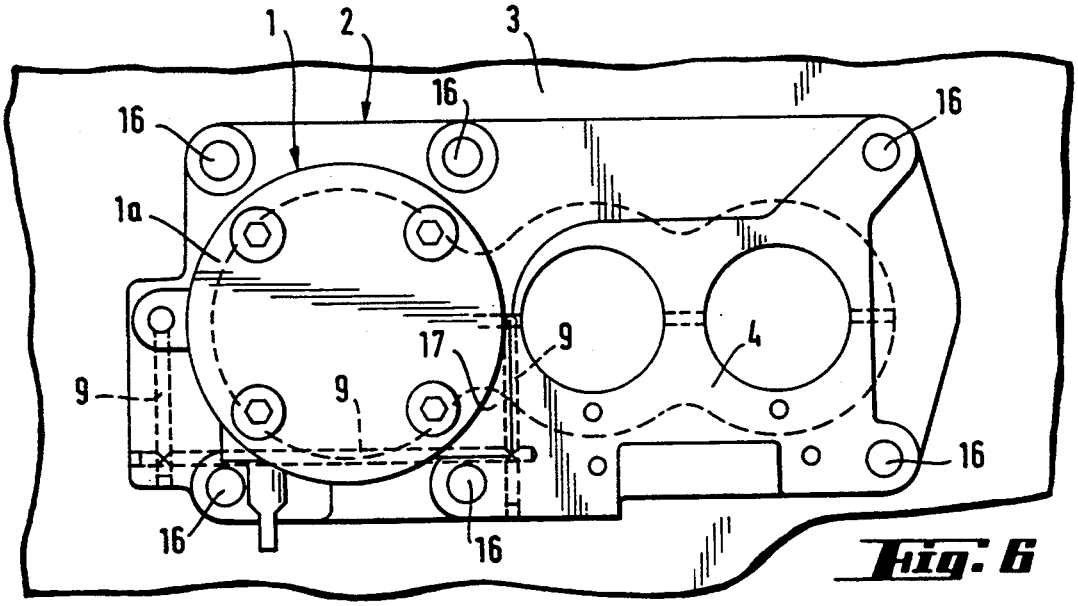
Figure 7:
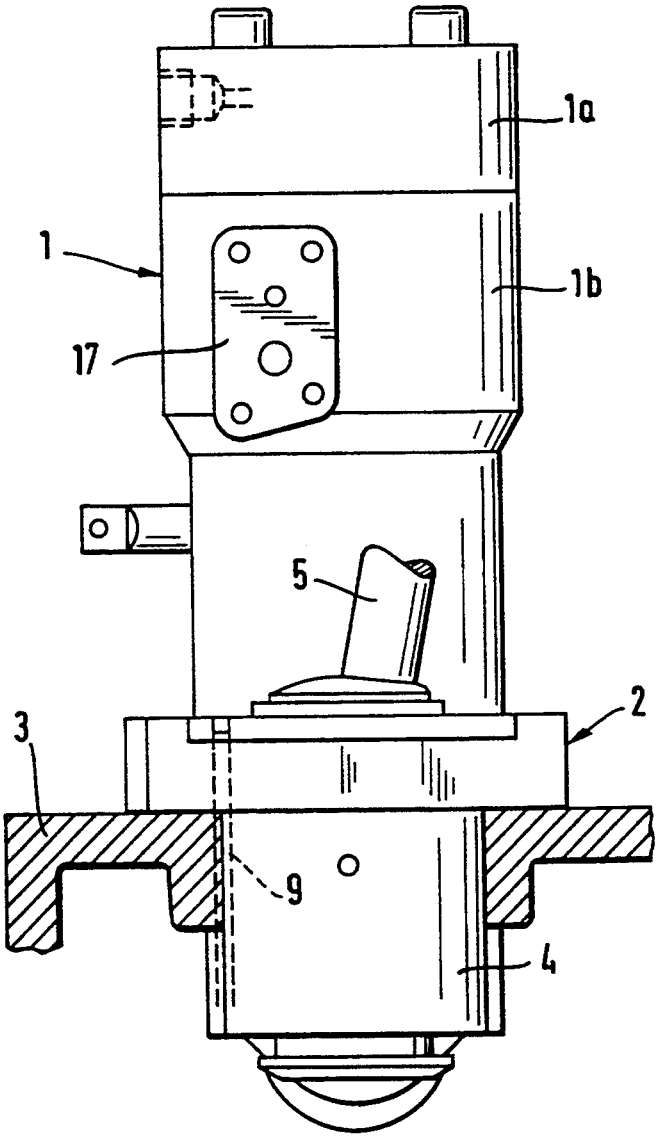

The invention will now be further described with reference to the accompanying drawing, in which FIG. 1 shows as a side view and partly in section an arrangement according to the invention, in which two support units for injection pumps are attached to each other, FIG. 2 shows the arrangement of FIG. 1 viewed from above, FIG. 3 shows view III—III of the arrangement of FIG. 1, FIG. 4 shows an alternative solution for attaching two support units for injection pumps to each other, FIG. 5 shows another simplified arrangement according to the invention as a side view and partly in section, FIG. 6 shows the arrangement of FIG. 5 viewed from above, and FIG. 7 shows view VII—VII of the arrangement of FIG. 5.

In the drawing the reference numeral 1 indicates a fuel injection pump, which comprises a cover member 1*a* and a body member 1*b*. The body member 1*b* includes a cylinder 12 and inside it a reciprocatingly movable piston member 6 arranged to feed fuel, through its movement, with high pressure further into a cylinder of an internal combustion engine, which is known as such and therefore not shown more in detail in the figures. The injection pump 1 is by means of a support unit 2 fixed to a pump console support 3, which can be an integral part of the engine block or a separate part fixed thereto. Fixing can be accomplished by means of bolts, for which purpose the support unit 2 includes holes 16.

In the embodiment according to FIGS. 1–3 the body member 1*b* of the injection pump and the support unit 2 form one integral body. The support unit 2 includes a first channel arrangement 7, which is connectable to the pipes of the fuel feeding system of the engine for feeding fuel via channels 7*a* and 7*b* into the pump cylinder 12. In addition the support unit includes a second channel arrangement 8, 8*a* and 8*b* for leading excessive fuel away from the pump back into the fuel feeding system for recirculation. The channels 7 and 8 of the support unit are connected to the fuel feeding system by making use of flange arrangements 15.

The support unit 2 includes further as an integral part thereof guiding means 4 arranged for lifting arms 5 for suction and/or discharge valves of an engine cylinder. In accordance with the embodiments shown in the figures said guiding means 4 comprise guiding cylinders, through which the lifting arms 5 are led through the pump console support 3 and by means of which, at the same time, the lifting arms 5 are movably supported to the pump console support 3.

The support units 2 can also with advantage be provided with channels 9 for feeding lubricant so as to provide lubrication for the piston member 6 of the injection pump and for the valve lifting means 5.

FIGS. 1–3 show further how two adjoining support units 2 can with advantage be connected to each other. For this purpose the channels 7*a* of the successive support units are connected to each other by means of flange arrangements 10, and a corresponding arrangement is provided for the channels 8*a*.

FIG. 4 shows an alternative way for connecting the channels 7*a*, and 8*a* respectively, of successive support units 2 to each other by means of sleeve elements 11*a* and 11*b*, which are sealed by means of packings 13*a* and 13*b* to the attachment members 14*a* and 14*b* arranged in the support units 2.

With the support unit arrangements according to FIGS. 1–4 feeding of fuel and leading-away of excessive fuel in the vicinity of the injection pumps is accomplished through the channels 7 and 8, which are produced by casting together with the support unit so as to form an integral part thereof, whereby the drawbacks relating to separate pipes can effectively be eliminated. The arrangement is also advantageous in view of production technique and space requirements.

FIGS. 5–7 show a simplified support unit arrangement, in which the support unit 2 still includes the guiding means 4 for lifting arms 5 for suction and/or discharge valves of an engine cylinder as well as the channels 9 for providing lubrication. In this case, however, the support unit 2 and the body member 1*b* of the injection pump do not form a sole uniform body, but the support unit 2 is merely used for supporting and fixing the pump to the pump console support 3. Thus, in this version the pump must be attached to the fuel feeding system of the engine in a conventional way by attachment means 17 and by using separate not-shown pipes. An advantage over previously known solutions, however, is accomplished through combining the support means for the pump with the valve guiding means, which brings advantages in view of production technique and requires less space.

One possibility for implementing the idea of the invention is to combine the embodiments of FIGS. 1–3 and FIGS. 5–7. Then the arrangement comprises a support unit 2, which is provided with channels 7 and 8. The body member 1*b*, however, is not cast to form an integral part of the support unit 2, but the entire injection pump 1 is fixed separately to the support unit 2 or together with it directly to the pump console support 3. In this case the channels 7*a* and 8*a* can be formed to be an integral part of the body member 1*b* of the injection pump and sealed separately to the support unit 2, because hereby the sealing can be more easily carried out for instance by making use of O-rings.

Thus, the invention is not limited to the embodiments shown, but several modifications are feasible within the scope of the attached patent claims.

I claim:

1. A mounting and connection arrangement for fuel injection pumps in a large internal combustion engine comprising an engine block defining several cylinders, a separate injection pump associated with each cylinder, and a support means that is stationary relative to the engine block for supporting the injection pumps, wherein each injection pump comprises a pump body and a mounting unit, said mounting units being attached to the support means and each being detachable from the support means independently of the other mounting units, the mounting unit of each pump is formed with at least one fuel flow channel that is in communication with the pump body, and the arrangement further comprises a coupling means connecting the flow channels formed in the mounting units of the injection pumps associated with at least two adjoining cylinders so that the respective fuel flow channels form a continuous fuel flow conduit.

2. An arrangement according to claim 1, wherein the engine further comprises a fuel feeding system and said continuous fuel flow conduit is a fuel supply conduit connected between the injection pumps and the fuel feeding system.

3. An arrangement according to claim 2, wherein each mounting unit is formed with a fuel return channel.

4. An arrangement according to claim 3, further comprising a coupling means connecting the fuel return channels to form a continuous fuel return conduit for receiving excess fuel from the fuel injection pumps and returning the excess fuel to the fuel feeding system.

5. An arrangement according to claim 1, wherein the mounting unit of each pump is formed with a second fuel-flow channel and the pump body is disposed between the two fuel flow channels.

6. An arrangement according to claim 5, wherein the pump body of each fuel injection pump defines a pump cylinder and each pump comprises a piston fitted slidably within the pump cylinder, and wherein the two fuel flow channels are separately connected to the pump cylinder.

7. An arrangement according to claim 1, wherein the pump body of each fuel injection pump defines a pump cylinder and each pump comprises a piston fitted slidably within the pump cylinder, and the mounting unit is formed with channels for feeding lubricant to provide lubrication for the piston of the injection pump.

8. An arrangement according to claim 1, wherein the mounting unit comprises a guide means for guiding a lifting means for at least one valve associated with a cylinder of the engine, so that the valve lifting means extends through the support means by way of the guide means.

9. An arrangement according to claim 8, wherein the mounting unit is formed with channels for feeding lubricant to provide lubrication for the valve lifting means.

10. An arrangement according to claim 8, wherein the pump body of each fuel injection pump is integral with the mounting unit thereof.

11. An arrangement according to claim 1, wherein each mounting unit is a substantially uniform casting.

12. A mounting and connection arrangement for fuel injection pumps in a large internal combustion engine comprising an engine block defining several cylinders, a separate injection pump assembly associated with each cylinder, and a support means that is stationary relative to the engine block for supporting the pump assemblies, wherein each pump assembly defines a pump cylinder and has a mounting portion whereby the pump assembly is attached to the support means, each pump assembly being detachable from the support means independently of the other pump assemblies and each mounting portion being formed with at least one fuel flow channel that is in communication with the associated pump cylinder, and wherein the arrangement further comprises a coupling means connecting the flow channels formed in the mounting portions of the pump assemblies associated with at least two adjoining cylinders so that the respective fuel flow channels form a continuous fuel flow conduit.

13. An arrangement according to claim 12, wherein the engine comprises a fuel feeding system and said continuous fuel flow conduit is a fuel supply conduit connected between the injection pumps and the fuel feeding system.

14. An arrangement according to claim 13, wherein each mounting portion is formed with a fuel return channel.

15. An arrangement according to claim 14, further comprising a coupling means connecting the fuel return channels to form a continuous fuel return conduit for receiving excess fuel from the fuel injection pumps and returning the excess fuel to the fuel feeding system.

16. An arrangement according to claim 12, wherein each mounting portion is formed with a second fuel flow channel and each fuel injection pump comprises a pump body disposed between the two fuel flow channels.

17. An arrangement according to claim 16, wherein the two fuel flow channels are separately connected to the pump cylinder.

18. An arrangement according to claim 12, wherein each pump comprises a piston fitted slidably within the pump cylinder and the mounting portion is formed with channels for feeding lubricant to provide lubrication for the piston of the injection pump.

19. An arrangement according to claim 12, wherein the mounting portion comprises a guide means for guiding a lifting means for at least one valve associated with a cylinder of the engine, so that the valve lifting means extends through the support means by way of the guide means.

20. An arrangement according to claim 19, wherein the mounting unit is formed with channels for feeding lubricant to provide lubrication for the valve lifting means.

21. An arrangement according to claim 12, wherein the coupling means includes a duct member that is releasably attached to the mounting portions of the pump assemblies that are associated with said two adjoining cylinders.

22. An arrangement according to claim 12, wherein the coupling means includes a duct member that is removably fitted in the flow channels formed in the mounting portions of the pump assemblies that are associated with said two adjoining cylinders.

23. An arrangement according to claim 1, wherein the coupling means includes a duct member that is releasably attached to the mounting units of the injection pumps that are associated with said two adjoining cylinders.

24. An arrangement according to claim 1, wherein the coupling means includes a duct member that is removably fitted in the flow channels formed in the mounting units of the injection pumps that are associated with said two adjoining cylinders.

* * * * *